US007523002B2

(12) United States Patent
Griffiths

(10) Patent No.: US 7,523,002 B2
(45) Date of Patent: Apr. 21, 2009

(54) METHOD AND SYSTEM FOR CAUSE-EFFECT TIME LAPSE ANALYSIS

(75) Inventor: Roger Griffiths, Abu Dhabi (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/540,463

(22) PCT Filed: Nov. 21, 2003

(86) PCT No.: PCT/EP03/13145

§ 371 (c)(1),
(2), (4) Date: Jun. 23, 2005

(87) PCT Pub. No.: WO2004/059122

PCT Pub. Date: Jul. 15, 2004

(65) Prior Publication Data

US 2006/0116823 A1 Jun. 1, 2006

(30) Foreign Application Priority Data

Dec. 31, 2002 (EP) ..... 02293282

(51) Int. Cl.
*G01V 1/40* (2006.01)
*G01V 1/00* (2006.01)

(52) U.S. Cl. ..... 702/6; 367/27

(58) Field of Classification Search ..... 702/6–13; 367/25, 27, 33; 73/152.03, 152.05, 44, 46, 73/152.44, 152.46

See application file for complete search history.

(56) References Cited

U.S. PATENT DOCUMENTS

| | | | | |
|---|---|---|---|---|
| 2,671,346 | A * | 3/1954 | Banning, Jr. | 73/152.44 |
| 4,541,275 | A * | 9/1985 | Kerzner | 73/152.02 |
| 5,837,893 | A | 11/1998 | Chu | |
| 5,899,958 | A * | 5/1999 | Dowell et al. | 702/6 |
| 6,272,434 | B1 | 8/2001 | Leggett, III et al. | |
| 6,344,746 | B1 * | 2/2002 | Chunduru et al. | 324/339 |
| 6,529,833 | B2 * | 3/2003 | Fanini et al. | 702/7 |

FOREIGN PATENT DOCUMENTS

WO WO 00/50728 A 8/2000

OTHER PUBLICATIONS

Bargach et al., Real-Time LWD: Logging for Drilling, Autumn 2000, Oilfield Review, pp. 58-78.*
Peeters et al., Invasion In Space and Time, May 31 to Jun. 3, 1999, SPWLA 40th Annual Logging Symposium.*

* cited by examiner

*Primary Examiner*—Drew A Dunn
*Assistant Examiner*—Toan M Le
(74) *Attorney, Agent, or Firm*—Darla P. Fonseca; Jaime Castano; Dale Gaudier

(57) ABSTRACT

A method of evaluating changes for a wellbore interval involves acquiring a first log data from a logging sensor during a first pass over the wellbore interval, acquiring a second log data from the logging sensor during a second pass over the wellbore interval, calculating a plurality of delta values between the first log data and the second log data, deriving an observed effect using the plurality of the delta values, identifying a correlation between the observed effect and a casual event, and displaying the correlation on a display device.

13 Claims, 7 Drawing Sheets

METHOD AND SYSTEM FOR CAUSE-EFFECT TIME LAPSE ANALYSIS

BACKGROUND OF INVENTION

Well logs are measurements, typically with respect to depth, of selected physical parameters of earth formations penetrated by a wellbore. Well logs are typically recorded by inserting various types of measurement instruments disposed on an integrated measurement platform into a wellbore, moving the instruments along the wellbore, and recording the measurements made by the instruments. One type of well log recording includes lowering the instruments at the end of an armored electrical cable, and recording the measurements made with respect to the length of the cable extended into the wellbore. Depth within the wellbore is inferred from the extended length of the cable. Recordings made in this way are substantially directly correlated to measurement depth within the wellbore. Other methods for measurement include a "logging while drilling" (LWD) method, a "measurement while drilling" (MWD) method, and a memory logging method. The LWD method involves attaching the instruments to the lower portion of a drilling tool assembly used to drill the wellbore. LWD and wireline tools are typically used to measure the same sorts of formation parameters, such as density, resistivity, gamma ray, neutron porosity, sigma, ultrasonic measurement, etc. MWD tools are typically used to measure parameters closely associated with drilling, such as well deviation, well azimuth, weight-on-bit, mud flowrate, annular borehole pressure, etc.

The aforementioned well logging tools may be conveyed into and out of a well via wireline cable, drilling pipe, coiled tubing, slickline, etc. Further, LWD and MWD measurement methods allow for measurement in the drill string while the bit is cutting, or measurement while tripping down or up past a section of a borehole that had been drilled at a previous time.

Some measurement tools use a pressure modulation telemetry system, which modulates pressure of a drilling fluid (mud) flowing through the interior of the drilling tool assembly, to obtain well log data. However, a much larger quantity of well log data is stored in a recording device disposed in the log instrument, which is interrogated when the instrument is retrieved from the wellbore. This information is typically recorded with respect to time. A record of instrument position in the wellbore with respect to time made at the earth's surface is then correlated to the time/measurement record retrieved from the instrument storage device to generate a conventional "well log" of measurements with respect to wellbore depth.

Well logs are typically presented in a graphic form including a plurality of grids or "tracks" each of which is scaled from a selected lower value to a selected upper value for each measurement type presented in the particular track. A "depth track" or scale, which indicates depth in the wellbore, is typically positioned between two of the tracks. Depending on the needs of the particular user, any number of or type of measurements may be presented in one or more of the tracks. A typical well log presentation of an individual measurement is in the form of a substantially continuous curve or trace. Curves are interpolated from discrete measurement values stored with respect to time and/or depth in a computer or computer-readable storage medium. Other presentations include gray scale or color scale interpolations of selected measurement types to produce the equivalent of a visual image of the wellbore wall. Such "image" presentations have proven useful in certain types of geologic analysis.

Interpreting well log data includes correlation or other use of a very large amount of ancillary information. Such ancillary information includes the geographic location of the wellbore, geologic and well log information from adjacent wellbores, and a priori geological/petrophysical knowledge about the formations. Other information includes the types of instruments used, their mechanical configuration and records relating to their calibration and maintenance. Still other types of information include the actual trajectory of the wellbore, which may traverse a substantial geographic distance in the horizontal plane with respect to the surface location of the wellbore. Other information of use in interpreting well log data includes data about the progress of the drilling of the wellbore, the type of drilling fluid used in the wellbore, and environmental corrections applicable to the particular log instruments used.

Much of this ancillary information is applicable to any well log recorded with a particular type of well log instrument. For example, an instrument, which measures naturally occurring gamma radiation ("gamma ray"), has environmental corrections, which correspond only to the type of instrument. As one example, each wireline-type gamma ray device of a selected external diameter from a particular wireline operator has the same environmental corrections for "mud weight" (drilling fluid density). Other types of ancillary information are made available from the wellbore operator (typically an oil and gas producing entity). Examples of this type of information include the geographic location of the wellbore and any information from other wellbores in the vicinity. Still other types of ancillary information include records of initial and periodic calibration and maintenance of the particular instruments used in a particular wellbore. The foregoing is only a small subset of the types of ancillary information, which may be used in interpreting a particular well log.

FIG. 1 shows a typical manner in which well log data are acquired by "wireline" wherein an assembly or "string" of well log instruments (including logging sensors or "sondes" (8, 5, 6 and 3) as will be further explained) is lowered into a wellbore (32) drilled through the earth (36) at one end of an armored electrical cable (33). The cable (33) is extended into and withdrawn from the wellbore (32) by means of a winch (11) or similar conveyance known in the art. The cable (33) transmits electrical power to the instruments (including logging sensors 8, 5, 6, 3) in the string, and communicates signals corresponding to measurements made by the instruments (including logging sensors 8, 5, 6, 3) in the string to a recording unit (7) at the earth's surface. The recording unit (7) includes a device (not shown) to measure the extended length of the cable (33). Depth of the instruments (including logging sensors 8, 5, 6, 3) within the wellbore (32) is inferred from the extended cable length. The recording unit (7) includes equipment (not shown separately) of types well known in the art for making a record with respect to depth of the instruments (including logging sensors 8, 5, 6, 3) within the wellbore (32).

The logging sensors (8, 5, 6, and 3) may be of any type well known in the art for purposes of the invention. These include gamma ray sensors, neutron porosity sensors, electromagnetic induction resistivity sensors, nuclear magnetic resonance sensors, and gamma-gamma (bulk) density sensors. Some logging sensors, such as (8, 5, and 6) are contained in a sonde "mandrel" (axially extended cylinder) which may operate effectively near the center of the wellbore (32) or displaced toward the side of the wellbore (32). Others logging sensors, such as a density sensor (3), include a sensor pad (17) disposed to one side of the sensor housing (13) and have one or more detecting devices (14) therein. In some cases, the sensor (3) includes a radiation source (18) to activate the formations (36) proximate the wellbore (32). Such logging sensors are typically responsive to a selected zone (9) to one side of the wellbore (32). The sensor (30) may also include a caliper arm (15), which serves both to displace the sensor (30) laterally to the side of the wellbore (32) and to measure an apparent internal diameter of the wellbore (32).

The instrument configuration shown in FIG. 1 is only meant to illustrate in general terms acquiring "well log" data by "wireline" and is not intended to limit the scope of the invention.

FIG. 2 shows a typical configuration for acquiring well log data using a logging while drilling (LWD) and measurements while drilling (MWD) system (39). The LWD/MWD system (39) may include one or more collar sections (44, 42, 40, 38) coupled to the lower end of a drill pipe (20). The LWD/MWD system (39) includes a drill bit (45) at the bottom end to drill the wellbore (32) through the earth (36). In this example, drilling is performed by rotating the drill pipe (20) by means of a rotary table (43). However, drilling may also be performed by top drives and coiled tubing drilling with downhole motors. During rotation, the pipe (20) is suspended by equipment on a drill rig (10) including a swivel (24), which enables the pipe (20) to rotate while maintaining a fluid tight seal between the interior and exterior of the pipe (20). Mud pumps (30) draw drilling fluid ("mud") (26) from a tank or pit (28) and pump the mud (26) through the interior of the pipe (20), down through the LWD/MWD. system (39), as indicated by arrow (41). The mud (26) passes through orifices (not shown) in the bit (45) to lubricate and cool the bit (45), and to lift drill cuttings in through an annulus (34) between the pipe. (20), LWD/MWD system (39), and the wellbore (32).

The collar sections (44, 42, 40, 38) include logging sensors (not shown) therein which make measurements of various properties of the earth formations (36) through which the wellbore (32) is drilled. These measurements are typically recorded in a recording device (not shown) disposed in one or more of the collar sections (44, 42, 40, 38). LWD systems known in the art typically include one or more logging sensors (not shown) which measure formation parameters, such as density, resistivity, gamma ray, neutron porosity, sigma, etc. as described above. MWD systems known in the art typically include one or more logging sensors (not shown) which measure selected drilling parameters, such as inclination and azimuthal trajectory of the wellbore (32). MWD systems also provide the telemetry (communication system) for any MWD/LWD tool logging sensors in the drill string. Other logging sensors known in the art may include axial force (weight) applied to the LWD/MWD system (39), and shock and vibration sensors.

The LWD/MWD system (39) typically includes a mud pressure modulator (not shown separately) in one of the collar sections (44). The modulator applies a telemetry signal to the flow of mud (26) inside the system (39) and pipe (20) where the telemetry signal is detected by a pressure sensor (31) disposed in the mud flow system. The pressure sensor (31) is coupled to detection equipment (not shown) in the surface recording system (7A), which enables recovery and recording of information transmitted in the telemetry scheme sent by the MWD portion of the LWD/MWD system (39). As explained, the telemetry scheme includes a subset of measurements made by the various logging sensors (not shown separately) in the LWD/MWD system (39). The telemetry of the logging tools may also be determined using wireline cable (not shown), or electrical MWD telemetry (i.e., using electrical signals transmitted through the formation). The remainder of the measurements made by the logging sensors (not shown) in the LWD/MWD system (39) may be transferred to the surface recording system (7A) when the LWD/MWD system (39) is withdrawn from the wellbore (32).

In a similar manner to the wireline acquisition method and system shown in FIG. 1, the LWD/MWD acquisition system and method shown in FIG. 2 is only meant to serve as an example of how data are acquired using MWD/LWD systems, and is not in any way intended to limit the scope of the invention.

A typical one-dimensional well log data presentation is shown in FIG. 3. The data presentation shown in FIG. 3 is typically made substantially entirely from data recorded by the well log instrument and entered in the recording system by an operator at the wellsite. As described above, the well log data are typically presented on a grid-type scale including a plurality of data tracks (50, 54, 56). The tracks (50, 54, 56) include a header (57) which indicates the data type(s) for which a curve or curves, (51, 53, 55, 59) are presented in each track. A depth track (52), which shows the measured depth (or alternative depth measure such as true vertical depth) of the data is disposed laterally between the first (50) and second (54) data tracks. The depth tracks (52) may alternatively use a time-based scale. Data curves (51, 53, 55, 59) are presented in each of the tracks (50, 54, 56) corresponding to the information shown in the header (57). The example data presentation of FIG. 3 is only one example of data presentations which may be used with a method according to the invention and is not intended to limit the scope of the invention.

A presentation such as shown in FIG. 3 may include in the various curves (51, 53, 55, 59) "raw" data, such as values of voltages, detector counts, etc. actually recorded by the various logging sensors in the well log instrument (not shown in FIG. 3), or more commonly, shows values recorded by the logging sensors converted to values of a parameter of interest, such as natural gamma radiation level, resistivity, acoustic travel time, etc. These presentations may generally be made only from the raw data themselves and universally applied scaling and correction factors. Still other presentations of the various curves may include data to which environmental corrections have been applied. Typically, raw data and such minimally corrected data may be recorded at the wellsite without the need to enter significant amounts of data other than the data recordings from the instruments themselves.

SUMMARY OF INVENTION

In general, in one aspect, the invention relates to a method of evaluating changes for a wellbore interval. The method comprises acquiring a first log data from a logging sensor during a first pass over the wellbore interval, acquiring a second log data from the logging sensor during a second pass over the wellbore interval, calculating a plurality of delta values between the first log data and the second log data, deriving an observed effect using the plurality of the delta values, identifying a correlation between the observed effect and a causal event, and displaying the correlation on a display device.

In general, in one aspect, the invention relates to a system for evaluating changes for a wellbore interval. The system comprises a well log data acquisition system for acquiring a first log data and a second log data from a logging sensor during a plurality of passes over the wellbore interval, a well log data processing system, and a display device for displaying the correlation. The well log data processing system calculates a plurality of delta values between the first log data and the second log data, derives an observed effect using the plurality of the delta values, and identifies a correlation between the observed effect and a causal event.

In general, in one aspect, the invention relates to a computer system for evaluating changes for a wellbore interval. The computer system comprises a processor, a memory, a storage device, a computer display, and software instructions stored in the memory for enabling the computer system under control of the processor. The software instructions perform gathering a first log data from a logging sensor during a first pass over the wellbore interval, gathering a second log data from the logging sensor during a second pass over the wellbore interval, calculating a plurality of delta values between the first log data and the second log data, deriving an observed effect using the plurality of the delta values, identifying a correlation between the observed effect and a causal event, and displaying the correlation on the computer display.

Other aspects and advantages of the invention will be apparent from the following description and the appended claims.

DETAILED DESCRIPTION

Figure 1:
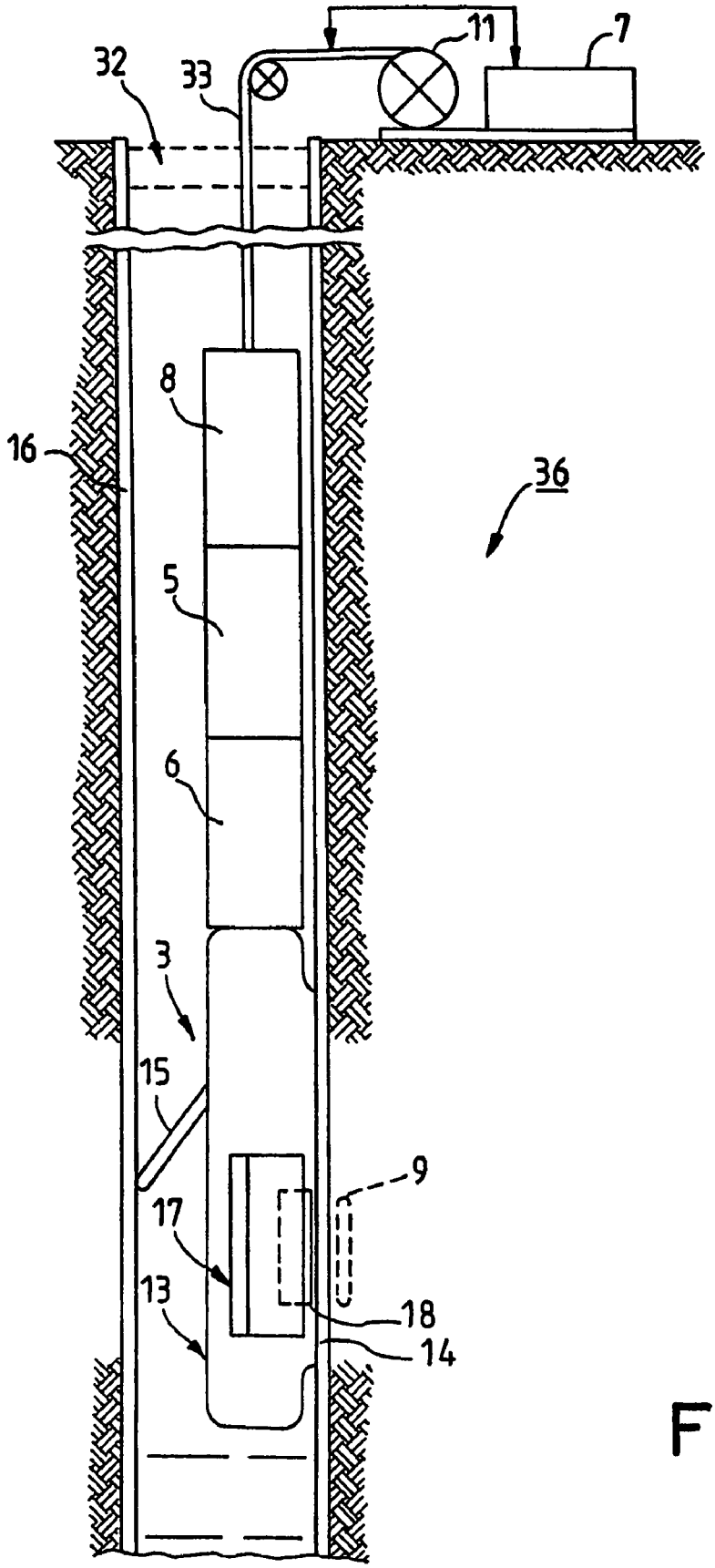
FIG. 1 shows typical well log data acquisition using a wireline conveyed instrument.
Figure 2:
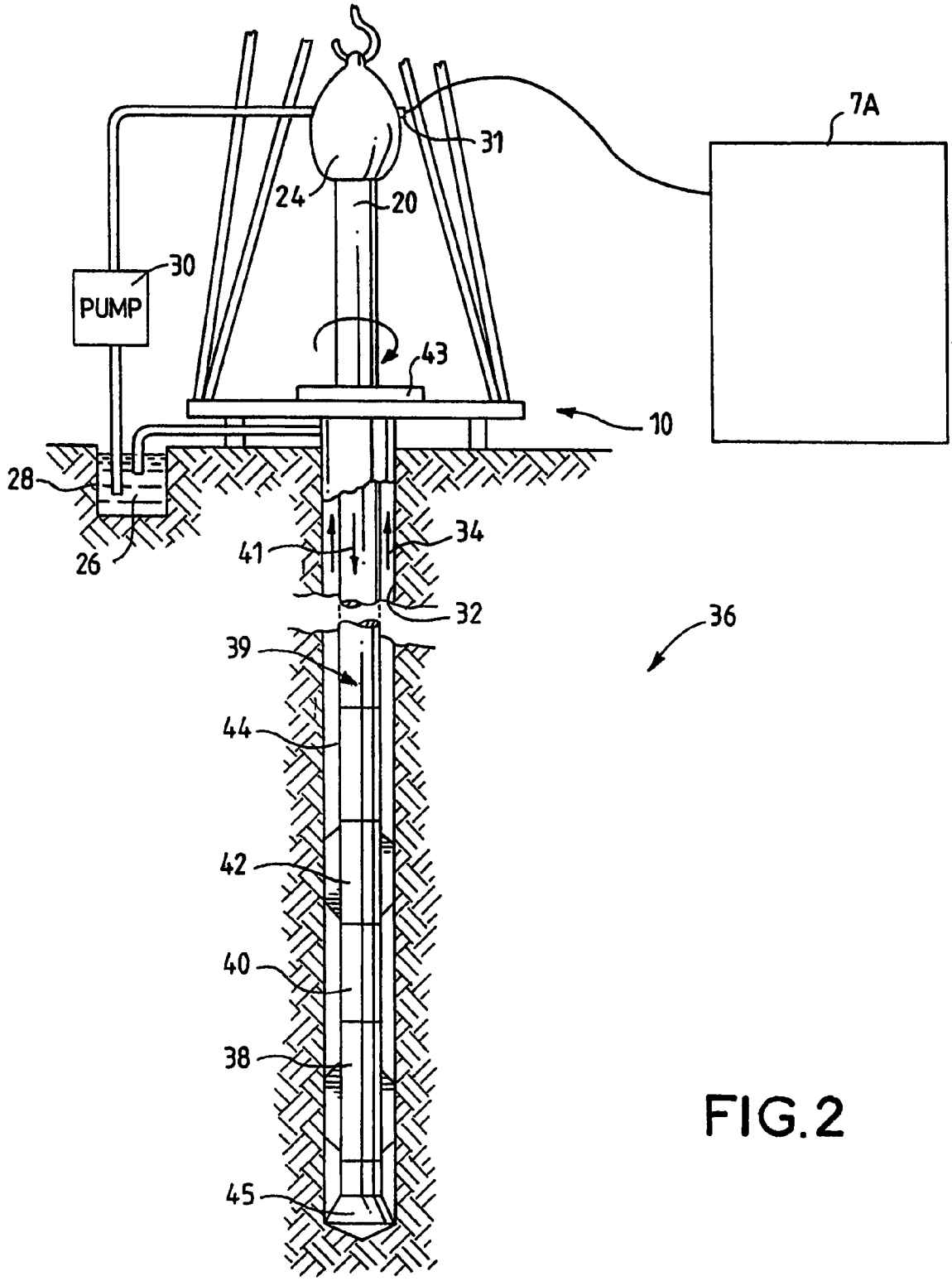
FIG. 2 shows typical well log data acquisition using a log while drilling/measurements while logging system.
Figure 3:
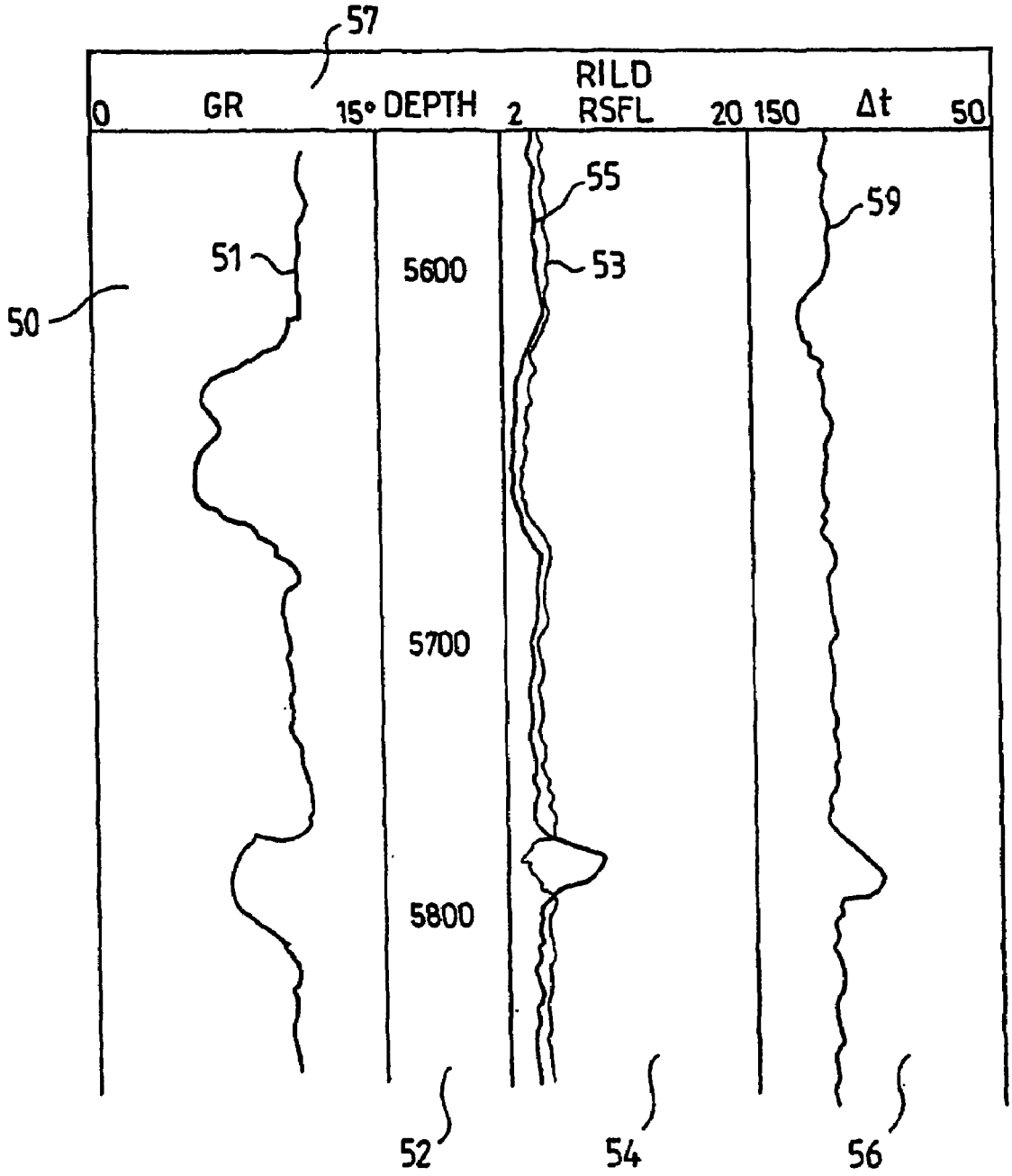
FIG.3 (PRIOR ART)
FIG. 3 shows an example of a well log data presentation.

Exemplary embodiments of the invention will be described with reference to the accompanying drawings. Like items in the drawings are shown with the same reference numbers.

In the following detailed description of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 4:
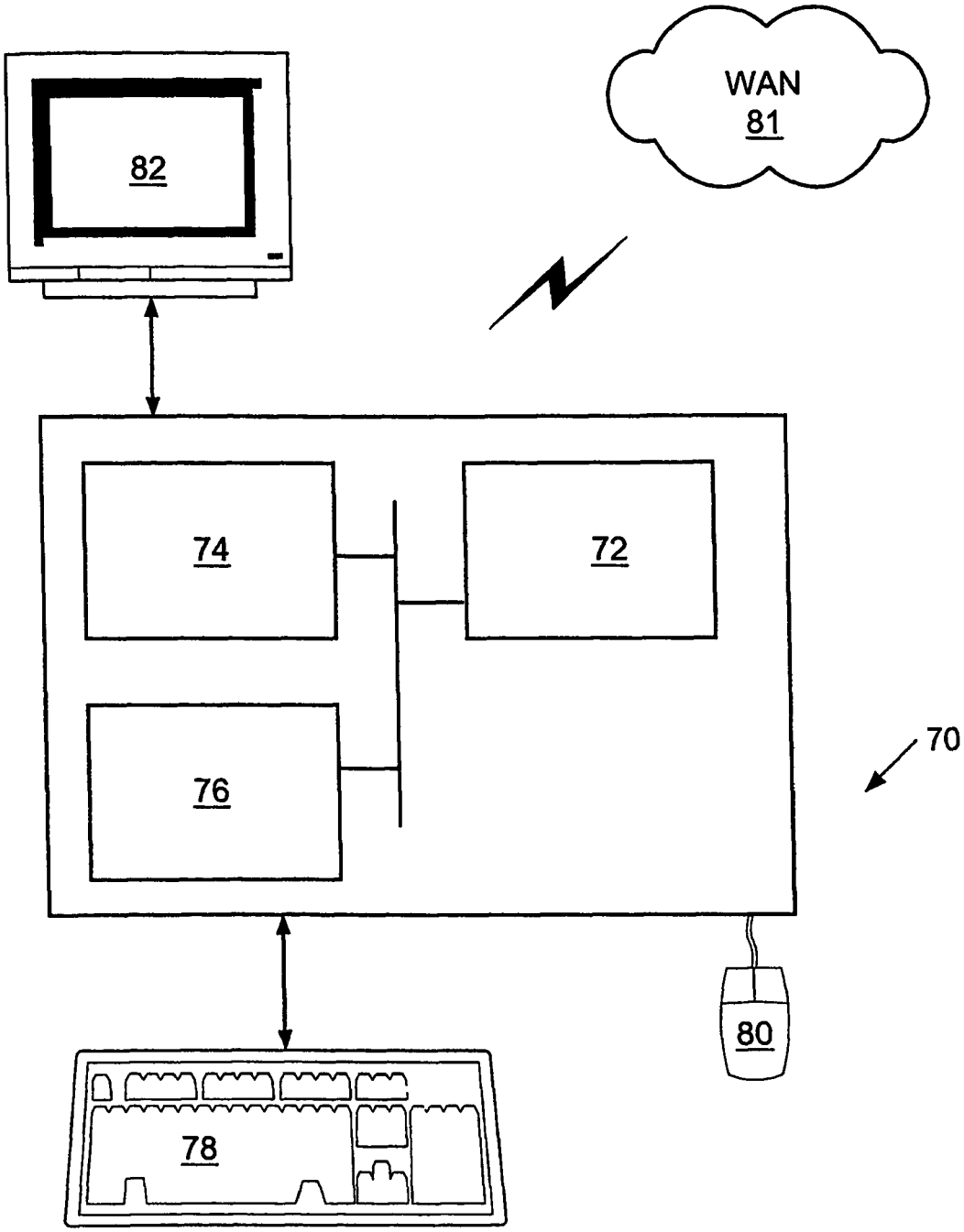
FIG. 4 (PRIOR ART)
FIG. 4 shows a typical networked computer system.

The invention may be implemented on virtually any type computer regardless of the platform being used. For example, as shown in FIG. 4, a typical networked computer system (70) includes a processor (72), associated memory (74), a storage device (76), and numerous other elements and functionalities typical of today's computers (not shown). The computer (70) may also include input means, such as a keyboard (78) and a mouse (80), and output means, such as a monitor (82). The networked computer system (70) is connected to a wide area network (81) via a network interface connection (not shown).

The invention relates to a method and system for analyzing a cause and effect of observed changes in well log data for a given wellbore interval. Further, in one embodiment, the analysis is displayed showing a correlation between observed changes in data acquired by a logging sensor during multiple passes over a given well bore interval and a causal event for the observed changes.

Figure 5:
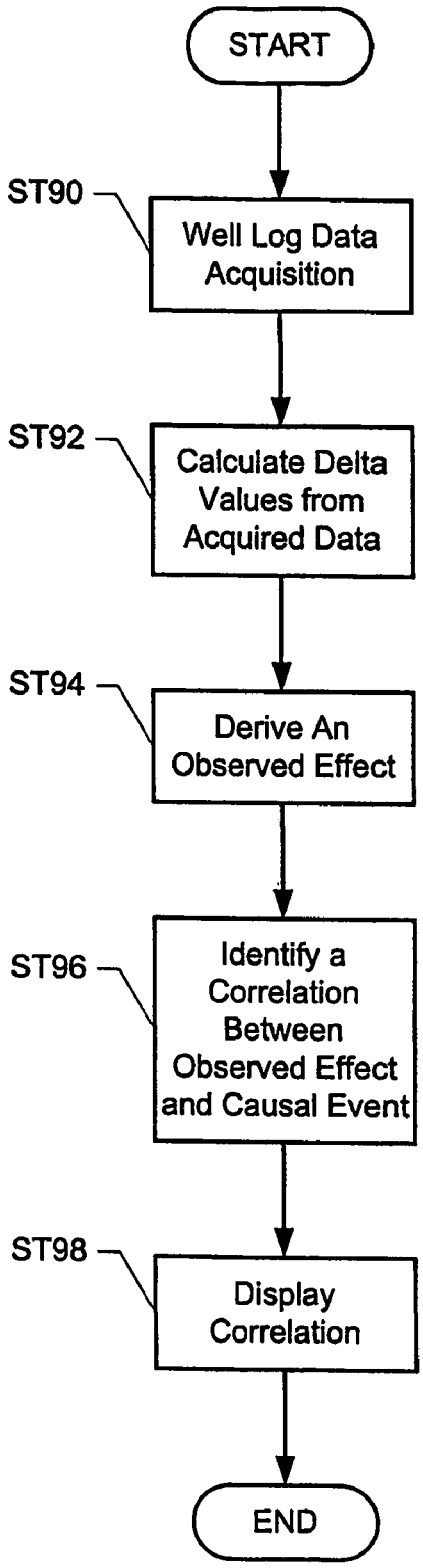
FIG. 5 shows a flowchart detailing the method in accordance with one embodiment of the invention.

FIG. 5 shows a flowchart of a methodology to analyze the cause and effect of observed changes in well log data for a given wellbore interval in accordance with one embodiment of the invention. Initially, well log data is acquired based on responses from the logging sensors (Step 90). As described above, a multitude of logging sensors may be disposed on the integrated measurement platform, e.g., a wireline tool, a LWD, a MWD tool, etc. While LWD tool measurements are used in the examples provided herein, the technique shown in FIG. 5 is generally applicable to any well log data set where sufficient information exists to derive cause-effect correlations.

The LWD tool acquires well log data while tripping up and down the wellbore. As discussed, the well log data may include measurement of selected formation parameters (i.e., gamma ray, resistivity, neutron porosity, density, sigma, etc.) and/or drilling parameters (i.e., borehole size, tool orientation, etc). While tripping the wellbore, the logging sensors may make multiple logging passes over a pre-defined wellbore interval. The wellbore interval may be defined by a single position or an interval of positions within the wellbore. During the time lapse between logging passes, the well log data acquired within the wellbore interval may change reflecting changes that occurred to formation and/or drilling parameters. A variety of explanations may exist for the changes such as wellbore fluid invasion of the formation, fracturing of the formation due to increases in wellbore pressure, formation changes due to chemical interaction between the formation and borehole fluids, etc.

Once the data is acquired, the acquired data associated with a particular formation or drilling parameter is compared for each pass of the logging sensor within the wellbore interval. The delta value for each formation or drilling parameter is calculated by taking the difference between the data associated with the formation or drilling parameter for the different passes of the logging sensor within the wellbore interval (Step 92). For example, while drilling the wellbore, logging sensors acquire well log data associated with the formation parameter of resistivity. During the first pass, the measurement of resistivity at the pre-defined wellbore interval is 150 ohms-m and during the second pass the measurement of resistivity is 200 ohms-m at the same wellbore interval. Thus, the delta value for the formation parameter of resistivity is 50 ohms-m for that time-lapse period over the pre-defined wellbore interval.

Using the delta values for selected formation and/or drilling parameters, an observed effect is derived (Step 94). Deriving the observed effect establishes the realization that a change within the wellbore has occurred. In one embodiment of the invention, the observed effect is derived by comparing the delta value of a particular formation or drilling parameter in context with other delta values. For example, a small delta value of a particular formation parameter and a large delta value of two formation parameters indicate a change to the formation parameter in the form of the occurrence of a particular observed effect.

However, determining the cause of that observed effect requires further analysis. By observing the causes most sensitive to a particular observed effect, a correlation may be identified between the observed effect and a causal event (Step 96). To determine the sensitivity of a particular causal event causing an observed effect in a measurement of formation or drilling parameters, the cross-correlation of various well log measurements is used. Correlations may be made in both the time and depth domains. Depth correlations are made when the formation parameters of interest are related to the formation measured by the LWD tool. A correlation may fall within one of three separate categories: (1) no significant correlation between the cause and effect; (2) a 1-to-1 correlation between cause and effect; and (3) a possible cause-effect correlation.

An example of where no significant correlation exists between the cause and effect is when an observed change in neutron porosity is deemed, for example, as unrelated to a change in mud resistivity. An example of a 1-to-1 correlation between the cause and effect is when an observed effect, such as the delta value of a caliper measurement reading being higher, is generally seen as an indication of a change in the diameter of the borehole. However, this conclusion should only be arrived at deductively after discounting alternative explanations, such as changes in the mud parameters or cuttings build-up in the borehole. An example of a possible cause-effect correlation is shown when a change in the resistivity indicates a formation fracturing. In that case, the change in the causal measurement between the two passes over a wellbore interval should be further investigated using related diagnostic measurements (e.g., delta pressure, equivalent circulating density, resistivity profile, etc.) and/or delta values for other formation or drilling parameters to successfully determine a cause-effect correlation with greater precision.

Once identified, the correlation may be displayed on a display device (Step 98). In one embodiment of the invention, a graphical user interface is provided that presents a multi-dimensional matrix on the display device. The multi-dimensional matrix may be designed such that each cell within the matrix indicates one of the three categories of correlations (i.e., no correlation, 1-to-1 correlation, or possible correlation).

Figure 6:
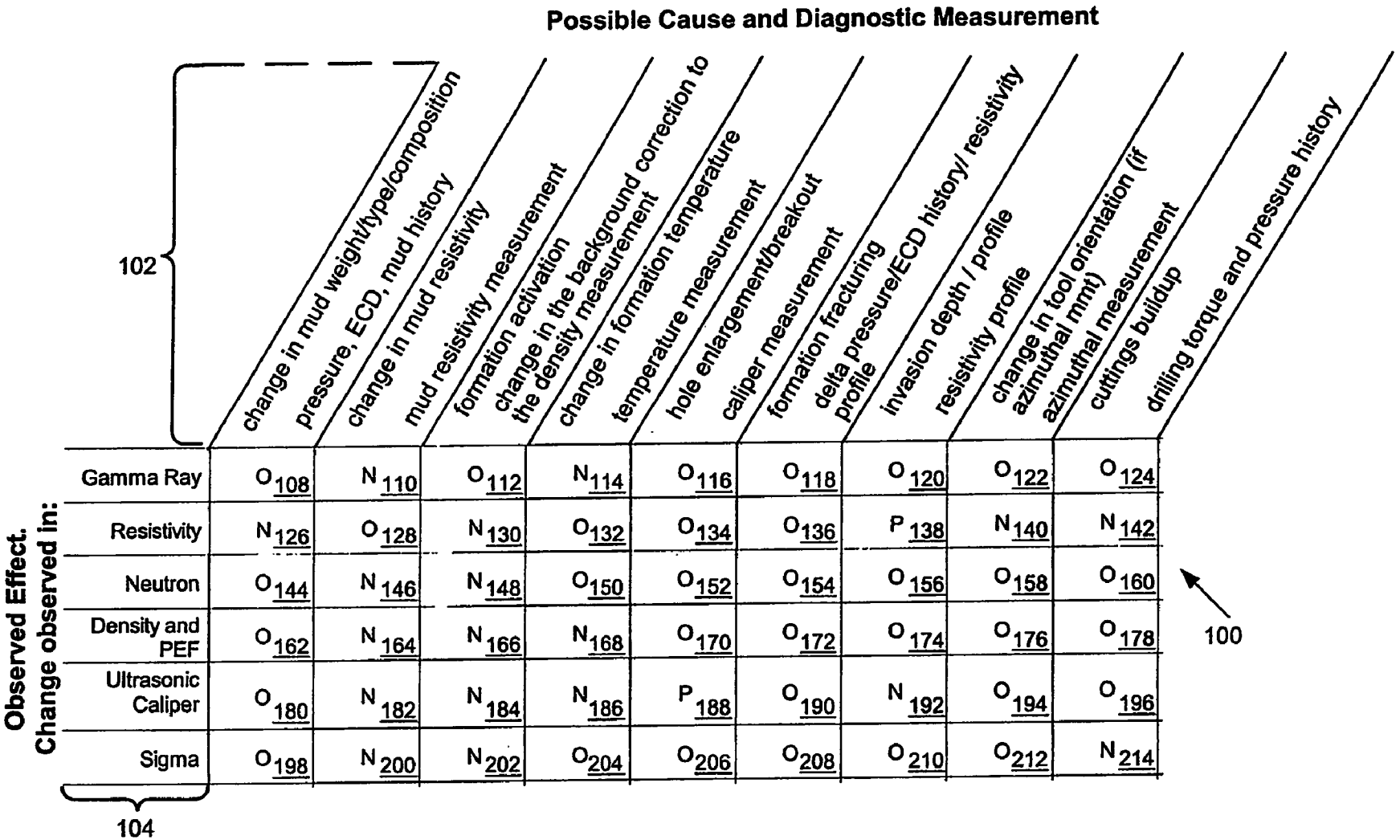
FIG. 6 shows a two-dimensional matrix in accordance with one embodiment of the invention.

FIG. 6 shows a two-dimensional matrix in accordance with one embodiment of the invention. The two-dimensional matrix (100) includes a header row (102) defining possible causes and the means to determine whether there has been a significant change in the causal parameters, and a header column (104) defining the major formation parameter measurements made by the LWD tool. A cell (108-214) exists for every possible correlation identified between the observed effect and a causal event. In some cases, such as cell (126), there may be a letter "N" or a gray shading (not shown) within the cell to indicate no significant correlation between the cause and effect. In other cases, such as cell (138), there may be a letter "P" or a pink shading (not shown) within the cell to indicate the correlation is 1-to-1 between cause and effect. Additionally, in some cases, such as cell (128), there may a letter "O" or a yellow shading (not shown) within the cell to indicate a possible cause-effect correlation.

Once the matrix is displayed, a user is able to analyze cause and effect of observed changes in the well log data for a given wellbore interval. Consider the example of a change in the measurement of the resistivity parameter. The two dimensional matrix shown in FIG. 6 indicates that the change could be due to a change in mud resistivity (128), formation temperature (132), borehole size (134), borehole fluid invasion (138), and/or fracturing of the formation (136). Typically, if a significant change in the observed resistivity parameter occurs, a cause of increased borehole fluid invasion seems to be suggested (as is indicated by the "P" in cell (138)). However, upon referencing the matrix and analysis of the pressure history, a significant change in the pressure at the corresponding depth at some time during the interval between the first and second resistivity measurements is shown. Possible causes could be formation fracturing or increased fluid invasion. By observing the matrix, a lack of a significant effect on the density and PEF and Sigma measurements suggests that the change does not occur uniformly around the borehole, thus indicating that fracturing is the most likely cause of the observed effect of the resistivity parameter. While the matrix in FIG. 6 still requires an understanding of the physics of each measurement to be able to make an interpretation of the results, such an interpretation is facilitated by the matrix.

Figure 7:
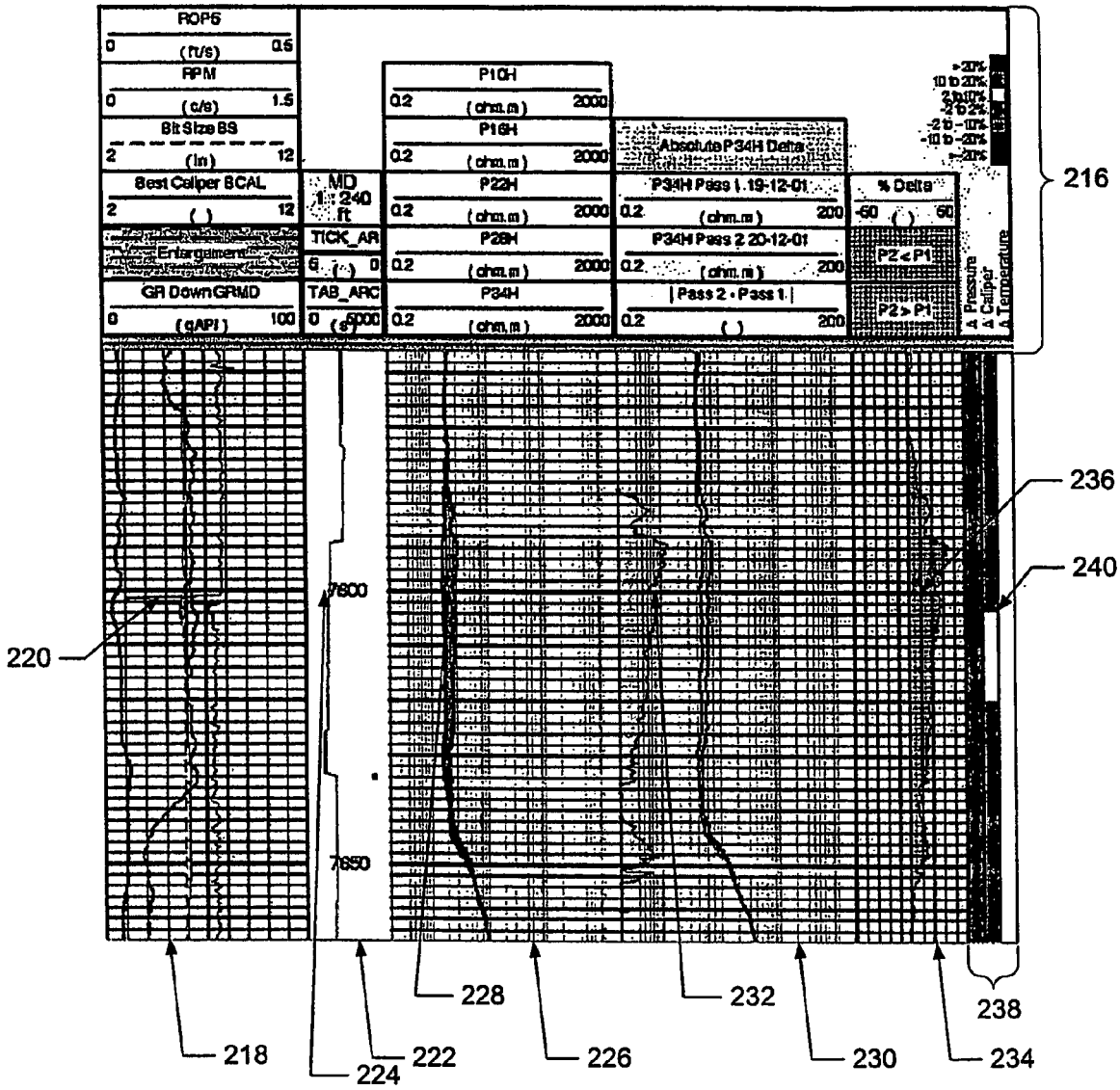
FIG. 7 shows a display of the cause-effect correlation in accordance with one embodiment of the invention.

FIG. 7 shows a data presentation display of a well log data in a manner to determine cause-effect correlation in accordance with one embodiment of the invention. The well log data is presented on a grid-type scale including a plurality of data tracks (218, 222, 226, 230, 234). The data tracks (218, 226, 230, 234) include a header (216) which indicates the data type(s) for which a curve or curves, (220, 224, 228, 232, 234) are presented in each track. A depth track (222), which shows the measured depth (or alternative depth measure such as true vertical depth) of the data is disposed laterally between the first (218) and second (228) data tracks. The depth tracks (222) may alternatively use a time-based scale.

Data track (218) includes data showing various measurements of drilling parameters. Data track (226) includes data showing various measurements of resistivity. In an embodiment of the invention, data track (230) shows resistivity for two specific passes over a wellbore interval and the absolute delta of the two passes while data track (234) shows a percentage delta for the two specific passes over a wellbore interval. Further, flag indicator bars (238) indicate percentage changes to well log data while tracking specific data curves related to delta values for pressure, caliper, and temperature measurements. The flag indicator bars (238) change color depending on the percentage change in the specific well log data being tracked.

The example data presentation of FIG. 7 is only one example of data presentation which may be used with a method according to the invention and is not intended to limit the scope of the invention.

By analyzing the data presentation display in a one-dimensional fashion, as shown in FIG. 7, an explanation or causal event for an observed effect may be determined. For example, in this data presentation, the change in resistivity indicated by the data curve (232) at an approximate wellbore interval of 7600-7640 (as shown by depth curve (224)) is seen to correlate with a 10-20% change in caliper in one section of the wellbore as is shown by the shaded area (236) in data track (234). Based on this information, a determination may be made that the majority of the change is due to increased formation invasion with hole enlargement having some effect over the wellbore interval as is indicated by the altered color of the flag in the delta caliper track (240).

While the one-dimensional view of a presentation yields valuable information, the use of the presentation in a multi-dimensional manner adds significant confidence to the interpretation that a particular phenomenon (i.e., causal event) is causing an observed effect in a measurement by using the cross-correlation of various well log measurements In one embodiment of the invention, introducing weighting or "sensitivity" multipliers to the cells (108-214) of the matrix further refine the technique. Accordingly, each of the possible causal events is weighted according to the degree to which a change in the causal event is reflected in the observed effect. The relative impact of a change (i.e., observed effect) on a given causal event could then be calculated as:

$$\text{Relative Effect} = \frac{\text{Sensitivity Factor} * \text{Change (\%)}}{\sum((\text{SensitivityFactor})_i * \text{Change (\%)}_i)}$$

The sum of the relative effects would yield a clearer indication of whether a given causal event is present.

Embodiments of the invention may have one of the following advantages. The invention allows the determination of an occurrence of a change in the wellbore and the identification of the probable causal event of the change. Further, by deriving the relative changes in formation parameters with respect to other parameters that may explain the change, the invention enables relatively easy recognition of a change in the wellbore and a visual guide as to sensitivity of a formation parameter to the change. Further, the use of a multi-dimensional matrix in a "two-dimensional" manner adds significant confidence to the interpretation that a particular causal event is causing an observed effect in a measurement of formation or drilling parameters by using the cross-correlation of various well log measurements. Those skilled in the art appreciate that the present invention may include other advantages and features.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method of evaluating changes for a wellbore interval, comprising:

obtaining first log data acquired by a logging sensor during a first pass over the wellbore interval;

obtaining second log data at a time later than the first log data, said second log data being acquired by the logging sensor during a second pass over the wellbore interval;

calculating a plurality of delta values between the first log data and the second log data, each delta value being calculated by taking a difference between a parameter of said first and second log data;

deriving an observed effect using the plurality of the delta values; and identifying a correlation between the observed effect and a causal event;

displaying said correlation on a display device so that changes for the wellbore interval can be evaluated as to the probable causal event responsible for the changes, wherein said correlation displaying comprises displaying a matrix comprising a header row defining possible causes in order to determine whether there has been a significant change in the parameter, and a header column defining the major formation parameter made by the logging sensors, a cell existing for every possible correlation identified between the observed effect and the probable causal event; and analyzing the causal event and changes for the wellbore interval based on the displayed matrix.

2. The method of claim 1, wherein the logging sensor measures at least one parameter selected from the group consisting of gamma ray, resistivity, neutron porosity, density, ultrasonic caliper, and sigma.

3. The method of claim 1, wherein the logging sensor is disposed on an integrated measurement tool.

4. The method of claim 1, wherein the correlation is a depth correlation.

5. The method of claim 1, wherein the correlation is a time correlation.

6. The method of claim 1, further comprising:

calculating a relative effect using a sensitivity factor to adjust the correlation; and displaying the correlation and the relative effect on the display device.

7. A system for evaluating changes for a wellbore interval comprising:

a well log data acquisition system for acquiring first log data and second log data, at a time later than said first log data, from a logging sensor during a plurality of passes over the wellbore interval; and a well log data processing system for:

calculating a plurality of delta values between the first log data and the second log data, each delta value being calculated by taking a difference between a parameter of said first and second log data;

deriving an observed effect using the plurality of the delta values;

identifying a correlation between the observed effect and a causal event;

displaying the correlation on a computer display device so that changes for the wellbore interval can be evaluated as to the probable causal event responsible for the changes, wherein said correlation displaying comprises displaying a matrix comprising a header row defining possible causes in order to determine whether there has been a significant change in the parameter, and a header column defining the major formation parameter made by the logging sensors, a cell existing for every possible correlation identified between the observed effect and the probable causal event; and analyzing the causal event and changes for the wellbore interval based on the displayed matrix.

8. The system of claim 7, wherein the logging sensor measures at least one parameter selected from the group consisting of gamma ray, resistivity, neutron porosity, density, ultrasonic caliper, and sigma.

9. The system of claim 7, wherein the logging sensor is disposed on an integrated measurement tool.

10. The system of claim 7, wherein the correlation is a depth correlation.

11. The system of claim 7, wherein the correlation is a time correlation.

12. The system of claim 7, further comprising a well log data processing system for calculating a relative effect using a sensitivity factor to adjust the correlation; and displaying the correlation and the relative effect on the computer display device.

13. A computer system for evaluating changes for a wellbore interval, comprising:

a processor;

a memory;

a storage device;

a computer display; and software instructions stored in the memory for enabling the computer system under control of the processor, to perform:

gathering first log data from a logging sensor during a first pass over the wellbore interval;

gathering second log data, at a time later than said first log data, from the logging sensor during a second pass over the wellbore interval;

calculating a plurality of delta values between the first log data and the second log data, each delta value being calculated by taking a difference between a parameter of said first and second log data;

deriving an observed effect using the plurality of the delta values;

identifying a correlation between the observed effect and a causal event;

displaying the correlation on the computer display so that changes for the wellbore interval can be evaluated as to the probable causal event responsible for the changes, wherein said correlation displaying comprises displaying a matrix comprising a header row defining possible causes in order to determine whether there has been a significant change in the parameter, and a header column defining the major formation parameter made by the logging sensors, a cell existing for every possible correlation identified between the observed effect and the probable causal event; and analyzing the causal event and changes for the wellbore interval based on the displayed matrix.

* * * * *